United States Patent [19]

Campbell

[11] Patent Number: 4,604,103

[45] **Date of Patent: * Aug. 5, 1986**

[54] DEPOSIT CONTROL ADDITIVES—POLYETHER POLYAMINE ETHANES

[75] Inventor: Curtis B. Campbell, Rodeo, Calif.

[73] Assignee: Chevron Research Company, San Francisco, Calif.

[ * ] Notice: The portion of the term of this patent subsequent to Mar. 20, 2001 has been disclaimed.

[21] Appl. No.: 809,101

[22] Filed: Dec. 16, 1985

Related U.S. Application Data

[63] Continuation of Ser. No. 403,607, Jul. 30, 1982, abandoned.

[51] Int. Cl.[4] ..... C10L 1/22

[52] U.S. Cl. ..... 44/72

[58] Field of Search ..... 44/72; 564/505

[56] References Cited

U.S. PATENT DOCUMENTS

| | | | |
|---|---|---|---|
| 3,440,029 | 4/1969 | Little et al. | 44/72 |
| 3,637,358 | 1/1972 | Cyba | 44/72 |
| 3,849,083 | 11/1974 | Dubeck | 44/72 |
| 3,960,965 | 6/1976 | Battersby et al. | 44/72 |
| 4,247,301 | 1/1981 | Honnen | 44/63 |
| 4,261,704 | 4/1981 | Langdon | 564/505 |

*Primary Examiner*—Y. Harris-Smith

*Attorney, Agent, or Firm*—S. R. LaPaglia; R. C. Gaffney; G. F. Swiss

[57] ABSTRACT

Additives for internal combustion engines are provided which in fuels maintain cleanliness of intake system without contributing to combustion chamber deposits. The additives are hydrocarbylopoly(oxyalkylene) polyamine ethanes comprising a hydrocarbyl-terminated poly(oxyalkylene) chain of 2–5 carbon oxyalkylene units bonded to an ethane or branched ethane chain in turn bonded to a nitrogen atom of a polyamine having from 2 to 12 amine nitrogens and from 2 to 40 carbon atoms with a carbon:nitrogen ratio between 1:1 and 10:1.

5 Claims, No Drawings

DEPOSIT CONTROL ADDITIVES—POLYETHER POLYAMINE ETHANES

This is a continuation of application Ser. No. 403,607, filed July 30, 1982, which is now abandoned.

BACKGROUND OF THE INVENTION

1. Field of the Invention

Numerous deposit-forming substances are inherent in hydrocarbon fuels. These substances when used in internal combustion engines tend to form deposits on and around constricted areas of the engine contacted by the fuel. Typical areas commonly and sometimes seriously burdened by the formation of deposits include carburetor ports, the throttle body and venturies, engine intake valves, etc.

Deposits adversely affect the operation of the vehicle. For example, deposits on the carburetor throttle body and venturies increase the fuel to air ratio of the gas mixture to the combustion chamber thereby increasing the amount of unburned hydrocarbon and carbon monoxide discharged from the chamber. The high fuel-air ratio also reduces the gas mileage obtainable from the vehicle.

Deposits on the engine intake valves when they get sufficiently heavy, on the other hand, restrict the gas mixture flow into the combustion chamber. This restriction, starves the engine of air and fuel and results in a loss of power. Deposits on the valves also increase the probability of valve failure due to burning and improper valve seating. In addition, these deposits may break off and enter the combustion chamber possibly resulting in mechanical damage to the piston, piston rings, engine head, etc.

The formation of these deposits can be inhibited as well as removed by incorporating an active detergent into the fuel. These detergents function to cleanse these deposit-prone areas of the harmful deposits, thereby enhancing engine performance and longevity. There are numerous detergent-type gasoline additives currently available which, to varying degrees, perform these functions.

A complicating factor has, however, recently arisen. With the advent of automobile engines that require the use of nonleaded gasolines (to prevent disablement of catalytic converters used to reduce emissions), it has been found difficult to provide gasoline of high enough octane to prevent knocking and the concomitant damage which it causes. The chief problem lies in the area of the degree of octane requirement increase, herein called "ORI", which is caused by deposits formed in the commercial gasoline.

The basis of the ORI problem is as follows: each engine, when new, requires a certain minimum octane fuel in order to operate satisfactorily without pinging and/or knocking. As the engine is operated on any gasoline, this minimum octane increases and, in most cases, if the engine is operated in the same fuel for a prolonged period, will reach an equilibrium. This is apparently caused by an amount of deposits in the combustion chamber. Equilibrium is typically reached after 5000 to 15,000 miles of automobile operation.

The octane requirement increase in particular engines used with commercial gasolines will vary at equilibrium from 5 or 6 octane units to as high as 12 or 15 units, depending upon the gasoline compositions, engine design and type of operation. The seriousness of the problem is thus apparent. A typical automobile with a research octane requirement of 85, when new, may after a few months of operation require 97 research octane gasoline for proper operation, and little unleaded gasoline of that octane is available. The ORI problem also exists in some degree with engines operated on leaded fuels. U.S. Pat. Nos. 3,144,311, 3,146,203 and 4,247,301 disclose lead-containing fuel compositions having reduced ORI properties.

The ORI problem is compounded by the fact that the most common method for increasing the octane rating of unleaded gasoline is to increase its aromatic content. This, however, eventually increases even more the necessary octane requirement. Moreover, some presently used nitrogen-containing compounds used as deposit-control additives and their mineral oil or polymer carriers may also significantly contribute to ORI in engines using unleaded fuels.

It is, therefore, particularly desirable to provide deposit control additives which effectively control the deposits in intake systems of engines, without themselves eventually contributing to the problem. The present invention discloses a new class of compounds which seek to do exactly that.

2. Prior Art

A prior class of deposit control additives generally including polyether amines includes U.S. Pat. No. 3,864,098 disclosing N-hydrocarby-N-heterocyclic polyamines displaying detergency in fuel concentration of 10–4,000 ppm. U.S. Pat. No. 4,247,301 teaches hydrocarbyl polyoxyalkylene polyamines as deposit control agents in fuels and dispersants in lubricating oils. U.S. Pat. No. 4,160,648 discloses deposit control additives, fuels containing them and lubricating oils having them as dispersant agents comprised of polyoxyalkylene carbamates.

SUMMARY OF THE INVENTION

Additives are provided which, when added to fuels or used as fuel concentrates, are effective in maintaining the cleanliness of engine intake systems. The additives consist of certain fuel soluble hydrocarbyl-terminated polyoxyalkylene polyamine ethanes soluble in hydrocarbon fuel boiling in the gasoline range. The polyoxyalkylene moiety comprises at least one hydrocarbyl-terminated polyoxyalkylene chain of 2 to 5 carbon atom oxyalkylene units. The polyoxyalkylene chain is bonded through a terminal oxygen to an ethane or branched ethane chain or connecting group which is in turn bonded to a nitrogen atom of a polyamine having from about 2 to about 12 amine nitrogens at or about 2 to about 40 carbon atoms with a carbon-nitrogen ratio of between 1:1 and 10:1. The hydrocarbyl-terminating group contains from 1 to 30 carbon atoms and is bonded to the polyoxyalkylene units through an ether oxygen atom. The compounds have a molecular weight in the range of about 300 to about 2500 and preferably from about 800 to 1500. Certain sorts of additives of the present invention are believed to be useful as dispersant additives in lubricating oils, as well.

DETAILED DESCRIPTION OF THE INVENTION

The present invention herein consists of the fuel additive, a polyoxyalkylene polyamine ethane, and a fuel composition containing a major amount of a liquid hydrocarbon fuel and from about 30 to about 10,000 ppm of said additive. The polyoxyalkylene polyamine ethane has a molecular weight of from about 300 to about 2500 and preferably from about 800 to about 1500. The additive consists of three parts or moieties. One is the polyamine moiety, the second the poly(oxyalkylene) moiety comprising at least one hydrocarbyl-terminated polyoxyalkylene polymer, bonded through the third moiety, an ethane connecting group or linkage, connected in turn to the nitrogen atom of the polyamine.

As fuel additives, the polyoxyalkylene moiety, the polyamine moiety, and the ethane moiety are selected to provide solubility in the fuel composition and deposit control activity without contributing to octane requirement increase (ORI). As lubricating oil additives, the moieties may be selected to provide solubility in lubricating oil compositions and dispersant activity. The additives may be termed hydrocarbyl poly(oxyalkylene) polyamine ethanes or for convenience, "polyether polyamine ethanes". The additives may be prepared from the reaction of a suitable halogenating agent containing the desired ethane moiety, such as ethylene chlorohydrine, with the appropriate substituted epoxide, polymerizing to the polyoxyalkylene chain. This is in turn reacted with the appropriate hydrocarbyl cap which is followed by reaction of the capped polyether chloride with the appropriate polyamine to form the active composition.

Poly(oxyalkylene) Component

The polyoxyalkylene moiety is ordinarily prepared by the reaction of an appropriate chlorohydrine containing the desired ethane connecting group. In the preferred embodiment ethylene chlorohydrine is used, which is reacted under polymerization conditions with the lower alkylene oxides or oxiranes such as propylene oxide or butylene oxide. In the polymerization reaction, a single type of alkylene oxide may be employed. Copolymers, however, are equally satisfactory and random copolymers are readily prepared by contacting the ethylene chlorohydrine compound with a mixture of alkylene oxides. Blocked copolymers of oxyalkylene units also provide satisfactory polyoxyalkylene polymers for the practice of the present invention. Blocked copolymers are prepared by reacting the chlorohydrine with first one alkylene oxide and then the other in any order, or repetitively, under polymerization conditions.

The resulting polyoxyalkylene ethylene chloride is then reacted with the suitable hydrocarbyl cap to complete the precursor of the polyoxyalkylene moiety. The hydrocarbyl cap (R—) contains from 1 to about 30 carbon atoms, preferably from about 2 to about 20 carbon atoms. The hydrocarbyl group may be any straight chain or branched aliphatic, olefinic or alkyl aryl hydrocarbon chain. The hydrocarbyl cap is added to the polyoxyalkylene precursor by the addition of the desired compound group to the polyoxyalkylene ethylene chloride in a catalyzed reaction utilizing an acid ion exchange resin reaction.

The hydrocarbyl polyoxyalkylene ethane moiety consists of one or more, preferably 1 to 2, more preferably one hydrocarbyl-terminated poly(oxyalkylene) polymer, composed of oxyalkylene units containing 2 to about 5 carbon atoms. The poly(oxyalkylene) polymer contains at least one oxyalkylene unit, preferably 1 to 30 units, more preferably 5 to 30 units and most preferably 10 to about 25 oxyalkylene units.

The terminal oxygen atom in the polyoxyalkylene chain is bound to the ethane or substituted ethane connecting group, which in turn bound to a nitrogen atom of the polyamine.

In general, the poly(oxyalkylene) compounds are mixtures of compounds that differ in polymer chain length. However, their properties closely approximate those of a polymer represented by the average composition and molecular weight.

The ethane connecting group ordinarily consists of a 2-carbon chain ethylene group or an ethylene group with branched units extending from the carbons of the ethylene. The branches of the connecting group consist of low molecular weight alkyl groups of up to 2 carbon atoms. Additionally, in the present invention when the ethylene connecting groups contain branched alkyl groups, the branched groups will not contain the same number of carbon atoms as those extending from the oxyalkylene units of the polyoxyalkylene moiety.

The utilization of compounds containing the ethane or branched ethane connecting groups enhances the composition's use as a deposit control additive, ORI inhibitor, or dispersant agent by providing the molecule with less steric hindrance and greater polarity at the amine moiety end of the molecule. This allows the molecule to "bind" better to metal engine surfaces and/or in the system and combustion chamber deposits thereby enhancing its detergency effect.

Polyamine Component or Moiety

The polyamine moiety of the polyether polyamine is preferably derived from a polyamine having from about 2 to about 12 amine nitrogen atoms and from about 2 to about 10 carbon atoms. The polyamine preferably has a carbon to nitrogen ratio of from about 1:1 to about 10:1. The polyamine will contain at least 1 primary or secondary amine nitrogen atom. The polyamine may be substituted with a substituent group selected from (A) hydrogen; (B) hydrocarbyl groups from about 1 to about 10 carbon atoms; (C) acyl groups from about 2 to about 10 carbon atoms; and (D) monoketo, monohydroxy, monocyano, lower alkyl and lower alkoxy derivatives of (B), (C). "Lower", as used in lower alkyl and lower alkoxy, means a group containing about 1 to 6 carbon atoms. "Hydrocarbyl" denotes an organic radical composed of carbon and hydrogen which may be aliphatic, alicyclic, aromatic or combinations thereof, e.g. aralkyl. Preferably, the hydrocarbyl group will be free of aliphatic unsaturation, i.e., ethylenic and acetylenic, particularly acetylenic unsaturation. The substituted polyamines of the present invention are generally, but not necessarily, N-substituted polyamines. The acyl groups falling within the definition of the aforementioned (C) substituents are such as propionyl, acetyl, etc. The more preferred substituents are hydrogen, $C_1$ to $C_6$ alkyls, and $C_1$–$C_6$ hydroxyalkyls.

The more preferred polyamines finding use within the scope of the present invention are polyalkylene polyamines, including alkylene diamine and including substituted polyamines, e.g. alkyl and hydroxyalkyl substituted polyalkylene polyamines. Preferably the alkylene groups contain from 2 to 6 carbon atoms, there being preferably from 2 to 3 carbon atoms between the nitrogen atoms. Such groups are exemplified by ethyleneamines and include ethylene diamine, diethylene triamine, di(trimethylene) triamine, dipropylenetriamine, triethylenetetramine, etc. Such amines encompass isomers which are the branched-chain polyamines and the previously mentioned substituted polyamines, including hydroxy and hydrocarbyl-substituted polyamines. Among the polyalkylene polyamines, those containing 2 to 12 amine nitrogen atoms and 2 to 24 carbon atoms, are especially preferred and the $C_2$ to $C_3$ alkylene polyamines are most preferred, in particular, the lower polyalkylene polyamines, e.g. ethylene diamine, tetraethylenepentamine, etc.

In many instances a single compound will not be used as reactant in the preparation of the compositions of this invention, in particular the polyamine component. That is, mixtures will be used in which one or two compounds will predominate with the average composition indicated. For example, tetraethylene pentamine prepared by the polymerization of aziridine or the reaction of dichloroethylene and ammonia will have both lower and higher amine numbers, e.g. triethylene tetramine, substituted piperazines and pentaethylene hexamine, but the composition will be mainly tetraethylene pentamine and the empirical formula of the total amine composition will closely approximate that of tetraethylene pentamine.

Compositions

The final compositions comprising the present invention are prepared by the reaction of the hydrocarbyl capped polyoxyalkylene-ethane moiety containing a reactable chlorine or other halogen with the appropriately selected amine or polyamine. The basic substitution reaction yields the attachment of the polyamine to the polyoxyalkylene and the elimination of the hydrogen halide.

The class of preferred polyether polyamine ethanes may be described by the following formula:

$$R\text{-}(OCH_2\underset{\underset{R'}{|}}{CH})_x O\text{-}CHR^{++}CHR^{+++}\text{-}N\text{-}R''R'''$$

wherein

R = $C_1$ to $C_{30}$ aliphatic, olefinic or alkylaryl hydrocarbons;

where R′ = hydrogen, $CH_3$—, $C_2H_5$—;

where R″ and R‴, independently, = hydrogen, $$(\text{-}CH_2CH_2\overset{\overset{H}{|}}{N})_y H$$

wherein Y = 0 to 5;

where $R^{++}$ and $R^{+++}$ = H, or low molecular alkyl groups up to 5 carbons, and where R′ = $R^{++}$ and/or $R^{+++}$; and where x = 1 to 30 oxyalkylene units.

The polyether ethylene amines are generally used in hydrocarbon distillate fuel and, in particular, unleaded gasoline. The proper concentration of the additive necessary in order to achieve the desired deposit control effect or carburetor detergency is dependent upon a variety of factors including the type of fuel used, the presence of other detergents or dispersants or other additives, etc. Generally, however, and in the preferred embodiment, the range of concentration of the additive in the base fuel is 30 to 10,000 weight parts per million, preferably from 30 to 2,000 weight parts per million, and most preferably from 100 to 700 parts per million of polyether polyamine ethane per part of base fuel. If other detergents are present, a lesser amount of polyether polyamine ethane may be used.

The oils which find use in this invention are oils of lubricating viscosity derived from petroleum or synthetic sources. Oils of lubricating viscosity normally have viscosities in the range of 35 to 50,000 Saybolt Universal Seconds (SUS) at 100° F. and more usually from about 50 to 10,000 SUS at 100° F. Examples of such base oils are naphthenic bases, paraffin base and mixed base mineral oils, synthetic oils, for example, alkylene polymers, such as the polymers or propylene, butylene, etc. and mixtures thereof.

Usually included in the oils besides the subject additives are such additives as dispersants/detergents, rust inhibitors, antioxidants, oiliness agents, foam inhibitors, viscosity index improvers, pour point depressants, etc. Usually, these other additives will be present in amounts of from about 0.5 to 15 weight percent of the total composition. Generally, each of the additives will be present in the range from about 0.01 to 5 weight percent of the total composition.

It is also contemplated that the polyether polyamine ethanes may be used as concentrates, and could be used as additive to fuels or lubricating oils subsequent to their preparation. In concentrates, the weight percent of these additives will usually range from about 0.3 to 50 weight percent. The concentrate would ordinarily comprise an inert stable oleophilic organic solvent and the carrier of said solvent boiling in the range of from about 150 to 400° F. and the concentrate would preferably contain from about 10 to 50 weight percent of the polyether polyamine ethane compound.

The following example is presented to illustrate a specific embodiment of the practice of this invention and should not be interpreted as a limitation upon the scope of that invention.

EXAMPLE 1

Preparation of 1-Butyl-capped Polyoxyalkylene-2-N′-Ethylene Diamine Ethane

To an ice-cold solution of 2 mls (3 mmoles) ethylene chlorohydrine in 30 mls of $CH_2Cl_2$ was added 0.5 ml (3.8 mmoles) of boron trifluoride:diethylether (undistilled) in one portion under a nitrogen atmosphere. The cooling bath was removed and butylene oxide added dropwise. The temperature rose rapidly to approximately 40° C. An additional 30 mls (348 mmoles) of butylene oxide was added at such a rate as to maintain an even refluxing, i.e. approximately 2 drops per second. After the addition was complete, the reaction product was allowed to cool to room temperature over a four-hour period and was diluted with additional $CH_2Cl_2$. The solution was extracted with cold water, then with a saturated solution of sodium bicarbonate and then with additional water. The product was stripped without drying and afforded 23.4 grams of a translucent oil after pumping with high vacuum. The product was redried in diethylether over anhydrous magnesium sulfate and was stripped to afford 22.6 grams of polyoxyalkylene ethane chloride.

To a solution of 1.73 grams (2.2 mmoles) of the above chloroethylpolyol and 1.07 grams (5.4 meq) Amberlyst cation ion exchange resin ($H^+$ form) in 5 ml of hexane cooled in dry ice and under a nitrogen atmosphere, was transferred 2.0 ml (2.21 mmoles) of isobutylene. The reaction was warmed to room temperature with stirring.

After 88 hours, the reaction product was diluted with hexane, filtered and stripped to afford 1.7 grams of a clean oil. The crude product was taken up in diethylether and washed three times with water, dried over magnesium sulfate and stripped to afford 1.4 grams of a clean oil.

To an ice-cold solution of 15 ml (224 mmoles) of ethylene diamine was added 1.0 grams of the above product dropwise. The mixture was placed under a nitrogen atmosphere and brought to 80° C. After 23 hours the reaction was cooled, the aliquot removed, diluted with diethylether and washed with distilled water several times, using methanol to keep emulsions down. After neutrality was reached, as indicated by pH paper, using water washings, the ether layer was washed three more times with water, dried over anhydrous potassium carbonate and stripped to afford 0.9 gram of a yellow oil. The basic nitrogen of the resulting product was 2.35%.

All specific embodiments of the invention have been described in detail. It should be understood that the invention is to be given the broadest possible interpretation within the terms of the following claims.

What is claimed is:

1. A fuel composition comprising a major portion of hydrocarbon boiling in a gasoline range, and from 30 to about 10,000 ppm of hydrocarbyl polyoxyalkylene polyamine ethane of molecular weight from about 300 to about 2500 having the formula $$R\text{-}(OCH_2\underset{\underset{R'}{|}}{C}H)_x OCH_2CH_2\text{-}NR''R'''$$

wherein R is hydrocarbyl of from 1 to about 30 carbon atoms; R′ is selected from methyl and ethyl; x is an integer from 5 to 30; R″ and R‴ are independently selected from hydrogen and $-(CH_2CH_2NH)_yH$ wherein y is an integer from 0 to 5.

2. A fuel composition according to claim 1 in which said hydrocarbyl polyoxyalkylene polyamine ethane has a molecular weight of about 800 to about 1500.

3. A fuel composition according to claim 2 in which said R is hydrocarbyl of from 2 to 20 carbon atoms.

4. A concentrate comprising an inert stable oleophilic organic solvent boiling in the range of 150° to 400° F. and from 10 to 50 weight percent of the compound of claim 1.

5. A hydrocarbyl polyoxyalkylene polyamine ethane of molecular weight from about 300 to about 2500 having the formula $$R\text{-}(OCH_2\underset{\underset{R'}{|}}{C}H)_x OCH_2CH_2\text{-}NR''R'''$$

wherein R is hydrocarbyl of from 1 to about 30 carbon atoms; R′ is selected from methyl and ethyl; x is an integer from 5 to 30; R″ and R‴ are independently selected from hydrogen and $-(CH_2CH_2NH)_yH$ wherein y is an integer from 0 to 5.

* * * * *